US011974661B2

(12) United States Patent
Alinski et al.

(10) Patent No.: US 11,974,661 B2
(45) Date of Patent: May 7, 2024

(54) TOOTHBRUSH HEAD OR BRUSH CARRIER

(71) Applicant: Braun GmbH, Kronberg (DE)

(72) Inventors: Jens Alinski, Kelkheim (DE); Karen Lynn Claire-Zimmet, Kronberg (DE); Niclas Altmann, Niddatal (DE); Ulrich Störkel, Bad Nauheim (DE)

(73) Assignee: Braun GmbH, Kronberg (DE)

( * ) Notice: Subject to any disclaimer, the term of this patent is extended or adjusted under 35 U.S.C. 154(b) by 84 days.

(21) Appl. No.: 17/574,892

(22) Filed: Jan. 13, 2022

(65) Prior Publication Data

US 2022/0225755 A1 Jul. 21, 2022

(30) Foreign Application Priority Data

Jan. 18, 2021 (EP) ..... 21152113

(51) Int. Cl.
*A46B 9/04* (2006.01)
*A46B 7/06* (2006.01)

(52) U.S. Cl.
CPC ..... *A46B 9/04* (2013.01); *A46B 7/06* (2013.01); *A46B 2200/1066* (2013.01)

(58) Field of Classification Search
None
See application file for complete search history.

(56) References Cited

U.S. PATENT DOCUMENTS 6,363,565 B1 4/2002 Paffrath
7,788,756 B2 * 9/2010 Kraemer ..... A46B 9/028 15/28

(Continued)

FOREIGN PATENT DOCUMENTS

EP 2910143 A1 8/2015
JP 2003019030 A 1/2003

OTHER PUBLICATIONS

PCT Search Report and Written Opinion for PCT/IB2022/050394 dated Feb. 18, 2022, 12 pages.

(Continued)

*Primary Examiner* — Laura C Guidotti
*Assistant Examiner* — Dana Lee Poon
(74) *Attorney, Agent, or Firm* — Gregory S. Darley-Emerson

(57) ABSTRACT

A toothbrush head or a brush carrier having at least one carrier element including at least one shape-shifting tuft mounted thereon. The shape-shifting tuft raises from a mounting end on a mounting surface of the carrier element generally along an extension direction towards a free end of the shape-shifting tuft. The shape-shifting tuft has a length from the mounting base to the free end and comprises a plurality of fibers. The shape-shifting tuft has a first cross-section having a first cross sectional area and shape at a first length along the extension direction, and a second cross-section having a second cross-sectional area and shape at a second length along the extension direction, wherein the first cross-sectional area and the second cross-sectional area are substantially identical and the first cross-sectional shape and the second cross-sectional shape are different so that the first cross-sectional shape does not match the second cross-sectional shape independent from an angle by which the first cross-sectional shape is rotated and independent from a displacement of the first cross-sectional shape.

13 Claims, 10 Drawing Sheets

(56) References Cited

U.S. PATENT DOCUMENTS

| | | | | |
|---|---|---|---|---|
| 9,445,660 | B2 * | 9/2016 | Mintel | A46D 1/0238 |
| 9,723,912 | B2 * | 8/2017 | Chun | A46D 1/0276 |
| D852,509 | S * | 7/2019 | Zachar | D4/111 |
| 2013/0007968 | A1 * | 1/2013 | Driesen | A61C 17/222 15/22.1 |
| 2015/0238004 | A1 * | 8/2015 | Brik | A46B 9/025 15/167.1 |
| 2016/0015163 | A1 * | 1/2016 | Newman | A46B 9/02 15/167.1 |
| 2018/0021116 | A1 * | 1/2018 | Störkel | A61C 17/3436 15/167.1 |
| 2019/0125065 | A1 * | 5/2019 | Altmann | A46B 9/06 |

OTHER PUBLICATIONS

Extended EP Search Report and Search Opinion for 21152113.3 dated Jun. 16, 2021, 7 pages.

* cited by examiner

TOOTHBRUSH HEAD OR BRUSH CARRIER

FIELD OF THE INVENTION

The present disclosure is concerned with a toothbrush head or brush carrier comprising a tuft that has two cross-sections along its length that do not match when overlaid. The present disclosure is also concerned with a method of manufacturing such a toothbrush head.

BACKGROUND OF THE INVENTION

It is known that a head for an oral care implement can comprise a mounting surface, at least one twisted tuft comprising a plurality of fibers and having a base mounted on the mounting surface, the twisted tuft having an outer lateral surface, a longitudinal axis, a lower cross-sectional area extending in a plane that is perpendicular to the longitudinal axis and that is arranged at the base, and an upper cross-sectional area extending in a plane that is perpendicular to the longitudinal axis and that is arranged at the free end of the twisted tuft, the lower cross-sectional area and the upper cross-sectional area having substantially the same shape and size, wherein at least the fibers forming the outer lateral surface are each substantially straight and are all inclined with respect to the longitudinal axis in either a clockwise direction or in a counterclockwise direction, and the upper cross-sectional area is twisted with respect to the lower cross-sectional area by a twisting angle $\alpha$ and wherein the upper cross-sectional area is not congruent with the lower cross-sectional area when they are orthogonally projected onto each other along the longitudinal axis. Such a head for an oral care implement is generally disclosed in document EP 2 910 143 B1.

There is an interest in a toothbrush head or brush carrier and in a toothbrush comprising a tuft that is shaped in an even more versatile manner to allow more advanced toothbrush head or brush carrier or toothbrush designs that meet respectively advanced needs of the toothbrush head or brush carrier or toothbrush. There is further a need to provide a method to manufacture such an advanced tuft and a toothbrush head or brush carrier comprising such an advanced tuft.

SUMMARY OF THE INVENTION

In accordance with one aspect a toothbrush head or a brush carrier is provided that comprises at least one carrier element, at least one shape-shifting tuft mounted on the carrier element such that the shape-shifting tuft raises from a mounting end on a mounting surface of the carrier element generally along an extension direction towards a free end of the shape-shifting tuft, the shape-shifting tuft having a length from the mounting base to the free end, the shape-shifting tuft comprising a plurality of fibers, and the shape-shifting tuft having a first cross-section having a first cross sectional area and shape at a first length along the extension direction, and a second cross-section having a second cross-sectional area and shape at a second length along the extension direction, where the planes in which the cross-sections are taken are parallel to each other, preferably where the plane at the first length coincides with the mounting surface or is at least as close to the mounting surface as possible without the first cross-section crossing through the mounting surface and further preferably where the plane at the second length coincides with the free end or is at least as close to the free end as possible such that the second cross-section still crosses through all fibers that also cross through the first cross-section, and the first cross-sectional area and the second cross-sectional area are substantially identical and the first cross-sectional shape and the second cross-sectional shape are different so that the first cross-sectional shape does not match the second cross-sectional shape independent from an angle by which the first cross-sectional shape is rotated and independent from a displacement of the first cross-sectional shape.

In accordance with one aspect a toothbrush is provided that comprises such a toothbrush head or brush carrier.

In accordance with one aspect a method of manufacturing a toothbrush head is provided that comprises the steps of

- providing a mold insert having a least one cavity for defining a shape-shifting tuft, the cavity having a length and extending from a first side of the mold insert to a second side of the mold insert opposite to the first side along an extension direction,
  - wherein the cavity has a first cross section at a first length having a first cross-sectional shape and area and a second cross-section at a second length having a second cross-sectional shape and area,
  - where the planes in which the cross-sections are taken are parallel to each other, preferably where the plane at the first length coincides with the first side or is at least as close to the first side as possible without the first cross-section crossing through the first side and further preferably where the plane at the second length coincides with the second side or is at least as close to the second side as possible, and
  - the first cross-sectional area and the second cross-sectional area are substantially identical and the first cross-sectional shape and the second cross-sectional shape are different so that the first cross-sectional shape does not match the second cross-sectional shape independent from an angle by which the first cross-sectional shape is rotated and independent from a displacement of the first cross-sectional shape;
- introducing a plurality of fibers into the cavity, where each fiber has a first end and a second end, and the second ends of the fibers remain outside of the mold insert;
- at least one of melting the second ends of the fibers together so that a joint end of the plurality of fibers is formed or connecting the second ends of the fibers by applying a connecting material such as an adhesive so that a joint end of the plurality of fibers is formed, in each case the plurality of fibers and the joint end forming a shape shifting tuft;
- connecting the joint end with a carrier element, preferably by injection molding of the carrier element around the joint end; and
- removing the plurality of fibers from the cavity.

BRIEF DESCRIPTION OF THE DRAWINGS

The present disclosure will be further elucidated by a detailed description of example embodiments and with reference to figures. In the figures

DETAILED DESCRIPTION OF THE INVENTION

Figure 1A:
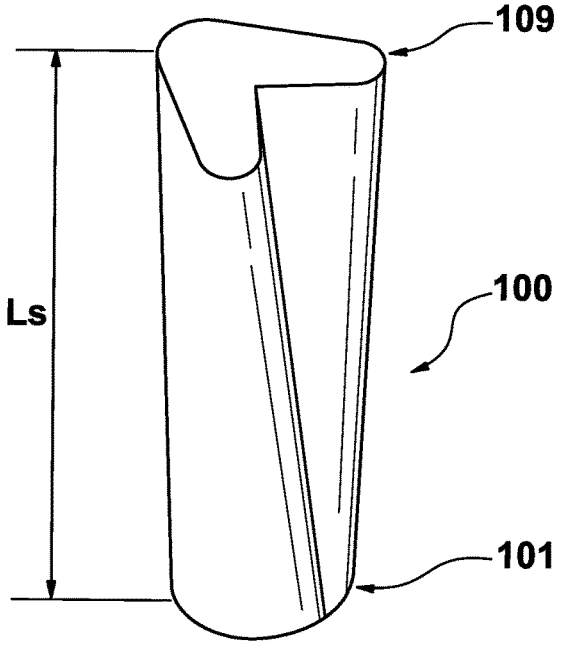
FIG. 1A is a first example embodiment of an example shape-shifting tuft in accordance with the present disclosure.

In the present disclosure a novel type or class of tufts is discussed, where a tuft of this type is herein named "shape-shifting tuft" for reasons of differentiating the proposed novel class of tufts from other tuft types. The term "tuft" alone thus comprises all possible kinds of tufts including shape-shifting tufts.

It is understood that a tuft comprises a plurality of fibers, e.g. 10 or 47 or 98 etc. fibers or any other number of fibers, that are in some manner connected, typically but not necessarily by either melting together the lower ends of the fibers or by connecting the lower ends togethers by using a connecting material such as an adhesive or a thermoplastic material. While the ends of the fibers that are connected are referred to as lower ends, the opposite upper ends of the fibers are referred to as the free ends as they are not connected and are intended to individually come into contact with the tooth surface in a tooth cleaning operation. The fibers may be made by cutting a natural or artificial filament into a desired length. Artificial filaments may be made from various plastic materials such as nylon (polyamid such as PA 6, PA 6.6, PA 6.10 PA 6.12 or PA 12), polybutylene terephthalate (PBT), polyethylene terephthalate (PET), polypropylene (PP), low density polyethylene (LDPE), polyphenylene sulfide (PPS), polyether ether ketone (PEEK) or any other suitable material. Filaments may have any suitable diameter such as between and including 0.075 mm (often also referred to as about 3 mil, where one mil is 0.0254 mm) and 0.5 mm, preferably between and including 0.1 mm and 0.3 mm, e.g. 0.1 mm, 0.125 mm, 0.15 mm 0.175 mm, 0.2 mm, 0.25 mm, 0.3 mm etc. Artificial filaments can have a variety of cross-sectional shapes such as circular, oval, x-profiled, star-shaped etc. Filaments may be co-extruded from two or more materials that differ at least in one material parameter such as a colorant additive and may have a core-sheath structure or an island-in-the-sea structure. Filaments may comprise any suitable additives such as colorants, abrasives, anti-bacterial materials, actives such as sodium fluoride (NaF) etc. Filaments may be twisted along their length or comprise indentations etc. Filaments for use in oral hygiene products such as toothbrushes are available from various suppliers such as Pedex GmbH, Wald-Michelbach, Germany or Dupont, Wilmington, Delaware, USA.

A shape-shifting tuft is characterized as follows:

- it comprises a plurality of fibers;
- it extends along an extension direction from a mounting base towards a free end, where the mounting base coincides with a mounting surface of a carrier element on which the shape-shifting tuft is mounted;
- it has a length measured along the extension direction from the mounting base towards the free end;
- it comprises a first cross-section taken at a first length and a second cross-section taken at a second length different to the first length, where the cross-sections are each taken in a plane and the two planes are parallel to each other;
- the first cross-section has a first cross-sectional area and a first cross-sectional shape and the second cross-section has a second cross-sectional area that is essentially identical with the first cross-sectional area and a second cross-sectional shape that is different to the first cross-sectional shape and cannot be matched with the first cross-sectional shape by rotation and/or displacement.

With respect to the "not matching" feature it shall be understood that this refers to the following: the second-cross-section is parallel-projected from the plane in which it is taken onto the parallel plane in which the first cross-section is taken. It is then not possible to match the first cross-section and the second cross-section by displacement and rotation in this joint plane, i.e. the first cross-section and the second cross-section cannot be made congruent by the displacement and rotation operations.

The shape-shifting tuft may have an outer surface extending between the first length and the second length that can be defined by straight lines that connect each point on the outer edge of the first cross-section with one point on the outer edge of the second cross-section such that every point on one of the edges has one and only one connected partner on the other edge.

As will be explained in more detail further below with respect to a method of manufacturing a shape-shifting tuft, a shape shifting tuft may comprise a connected end that may be connected with the carrier element and the connected end may not extend beyond the mounting surface, e.g. the connected end may be a molten mass of fiber material that was created by heating the respective ends of the shape-shifting tuft such that the material of the fibers melts and forms an essentially homogeneous mass of material once it is cooled and solidified.

A shape-shifting tuft is connected with a carrier element that has a mounting surface from which the visible portion of the shape-shifting tuft rises from a mounting end that coincides with the mounting surface to a free end of the shape-shifting tuft. The shape-shifting tuft generally extends along an extension direction. The mounting surface may be planar or may be curved (i.e. it may have a three-dimensional topography) or even stepped, i.e. the mounting surface may comprise at least one step where the surface is essentially having a discontinuity.

A circular tuft that is cut at two distant lengths by parallel planes has identical cross-sections in the two cutting planes—the cross-sectional areas and the cross-sectional shapes are always identical. This is independent from the angulation of the cutting planes with respect to the extension direction of the circular tuft. The same is correct for any other tuft having a non-changing cross-section. Hence, it is irrelevant which angle the cutting planes have against the extension direction as a shape shifting tuft will always have two non-matching cross-sectional shapes in two distant cutting planes. It is thus irrelevant to precisely define the extension direction of a tuft. But one may define the extension direction as follows: the shape-shifting tuft is cut by two parallel planes that are at a distance such that the first plane and the second plane cross through the same number of fibers. Then the center of area points of each of the cross-sections is identified. A straight line drawn to connect the two center of area points may then be said to be the extension direction that origins at the mounting end and goes through the free end. While the relation between extension direction and cutting planes may be irrelevant to define a shape-shifting tuft, the planes in which the cross-sections are taken may nonetheless be chosen to be, e.g., essentially perpendicular to the extension direction of the shape-shifting tuft or they may be parallel to a planar mounting surface of the carrier element or they may be parallel to a planar free end of the shape-shifting tuft.

As mentioned, the free end of the shape-shifting tuft may be planar, i.e. the free ends of all fibers forming the shape-shifting tufts end then in one plane. But this shall not exclude that the free end of the shape-shifting tuft has a non-planar topology where the free ends of the fibers forming the shape-shifting tuft end on a three-dimensional surface or where the free ends of the fibers forming the shape-shifting tuft end in an irregular manner.

As mentioned, the shape-shifting tuft has two cross-sections at two distinct length values along the extension direction that have two different cross-sectional shapes. The cross-sectional shape of the shape shifting tuft may preferably morph from the first cross-sectional shape into the second cross-sectional shape in a smooth manner, i.e. a plurality of cross-sectional cuts may be taken at a plurality of planes that are each parallel to the planes of the first and second cross-sections and the differences between the cross-sectional shapes become the smaller the closer the parallel planes are located along the extension direction. That means that the change of the cross-sectional shape occurs without any steps or sudden changes, i.e. the transition happens smoothly. In some embodiments, a straight line can be drawn from each point of the edge of the first cross-section to a point of the second cross-section such that each point on each of the two edges has one and only one partner on the other of the two edges. The plurality of straight lines does then determine the outer shape of the shape-shifting tuft at least between the two planes in which the first and second cross-sections are taken.

In accordance with some aspects, at least one of the cross-sectional shapes has at least one concavity, preferably wherein at least the second cross-sectional shape has a concavity. A free tuft end comprising a concavity may be supportive of good cleaning of a tooth surface as debris may be collected in the concavity. As the first cross-sectional shape may then not comprise a concavity but may be, e.g. circular or concavity-free, the mounting end of the shape-shifting tuft may benefit from a more stable construction that cannot be provided by a cross-sectional shape having a concavity as the fibers around the concavity may bend easier, i.e. under a lower applied force, and may thus provide a less pronounced cleaning effect. A shape-shifting tuft may thus balance good bending stability with good cleaning properties. But this is to be understood as just one example. In another example, a plurality of shape-shifting tufts is arranged on a carrier element so that their mounting bases can be optimally held by the carrier element due to their compressed shape but where the free ends of the tufts may have elongated and/or concave shapes In accordance with some aspects, a shape-shifting tuft may have an extension direction that is inclined with respect to a normal on the mounting surface at the mounting base of the shape-shifting tuft. In case of two or more shape-shifting tufts, these tufts may have different inclinations, i.e. in case of two shape-shifting tufts their extension directions may not be parallel but they may be inclined towards each other or away from each other such that the free ends of the tufts may be closer together or farther away from each other than their mounting ends.

As already mentioned, a brush carrier or toothbrush head may comprise more than one shape-shifting tuft, e.g. it may comprise two, three, four, five, six, seven, eight, nine, ten, eleven, twelve etc. shape-shifting tufts, where each of the shape-shifting tufts may be essentially identical with the other shape-shifting tufts or each of the shape-shifting tufts may be different to all the other shape-shifting tufts or at least one sub-group of shape-shifting tufts may have essentially identical shapes while the at least one other shape-shifting tuft has a different shape. Shape-shifting tufts may be provided together with at least one other tuft, e.g. a standard circular tuft or a tuft that has a constant cross-sectional shape or a twisted tuft as described in EP 2 910 143 B1. Instead of one such non-shape-shifting tuft a plurality of such non-shape-shifting tufts may be provided. Shape-shifting tufts may be provided in groups, e.g. they may be arranged in a ring-like tuft arrangement. One example brush carrier or toothbrush head with three shape-shifting tufts and one standard circular tuft is discussed in connection with FIGS. 4A, 4B, 5, 6A, 6B and 6C.

In accordance with some aspects, an example toothbrush head or brush carrier may have at least two shape-shifting tufts, preferably at least three shape-shifting tufts, that are inclined so that their free ends are closer to each other than their mounting bases, preferably wherein the shape-shifting tufts (e.g. their center of area points on the mounting surface) are approximately arranged on a circle or ellipse or oval, further preferably wherein a straight center tuft is mounted in the center of the circle, even further preferably where the free ends of the shape-shifting tufts encircle the center tuft, and even more further preferably wherein the three shape-shifting tufts each have a first cross-sectional shape that is elongated and oriented such that a long axis of the elongated first cross-sectional shape points towards a center point of the circle, ellipse or oval or is a tangential line of a circular, elliptical or oval center area of the circle, ellipse or oval and each of the at shape shifting tufts have a second cross-sectional shape at their free end that is curved around the center tuft ("curved" in the meaning of partially encircling).

Figure 1B:
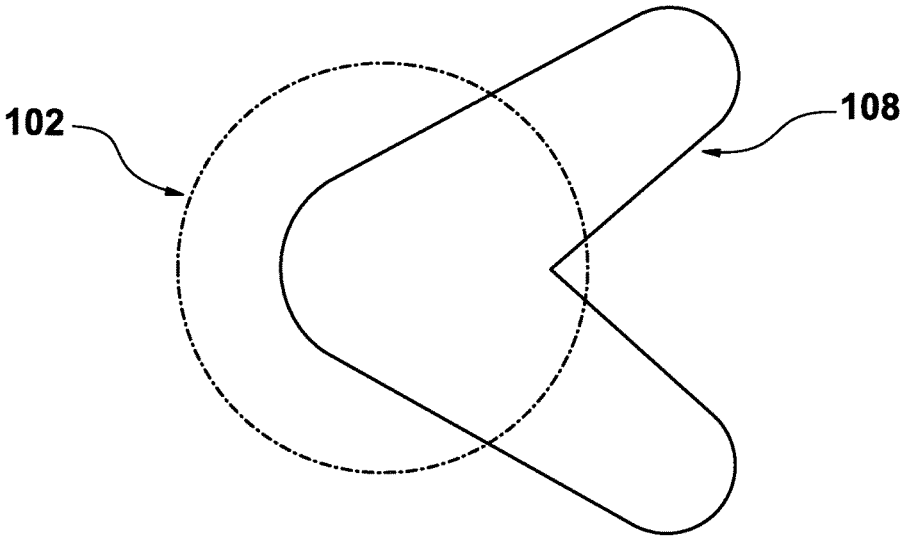
FIG. 1B is a schematic depiction of the cross-sectional shapes of a first cross section and a second cross-section of the shape-shifting tuft shown in FIG. 1A, the cross sections taken in planes coinciding with a mounting end and a free end of the tuft.
Figure 2A:
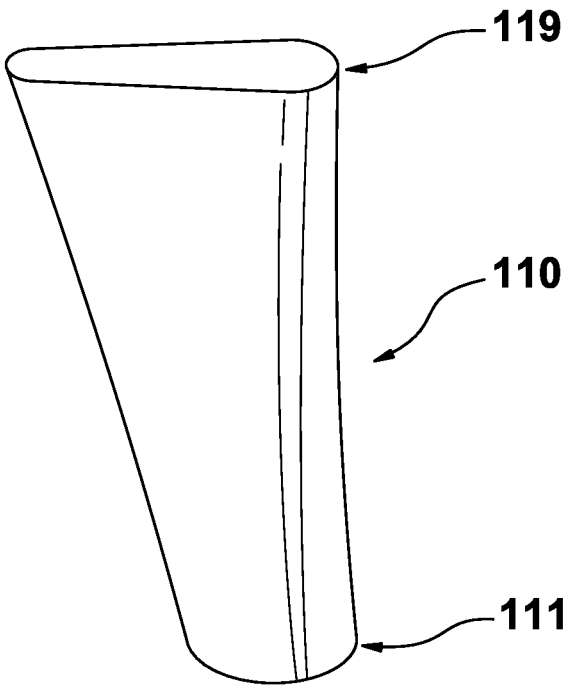
FIG. 2A is a second example embodiment of an example shape-shifting tuft in accordance with the present disclosure.
Figure 2B:
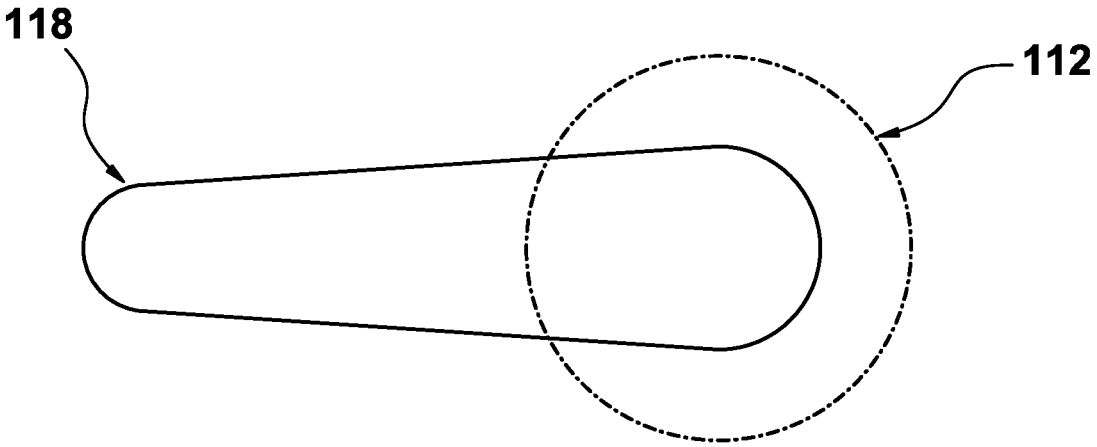
FIG. 2B is a schematic depiction of the cross-sectional shapes of the first cross section and the second cross-section of the shape-shifting tuft shown in FIG. 2A.
Figure 3A:
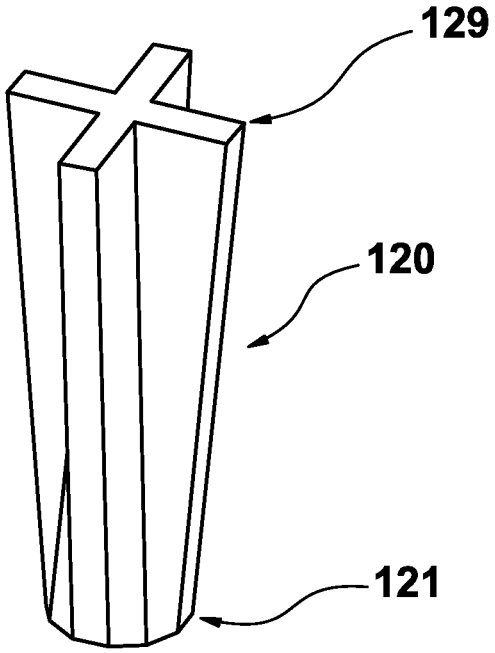
FIG. 3A is a third example embodiment of an example shape-shifting tuft in accordance with the present disclosure.

Example Shape-Shifting Tufts FIGS. 1A, 1B, FIGS. 2A, 2B and FIGS. 3A, 3B show three different example shape-shifting tufts 100, 110 and 120, where FIGS. 1A, 2A and 3A sow a perspective view onto the respective shape-shifting tuft 100, 110 and 120. In these examples, it is assumed that the mounting surface is flat and that the free end of the shape-shifting tuft is also flat so that the first cross-section is always taken at the level of the mounting surface, i.e. at length value 0, and the second cross-section is always taken at the level of the planar free end, i.e. at length value Ls, where Ls is the free length of the shape-shifting tuft.

Figure 3B:
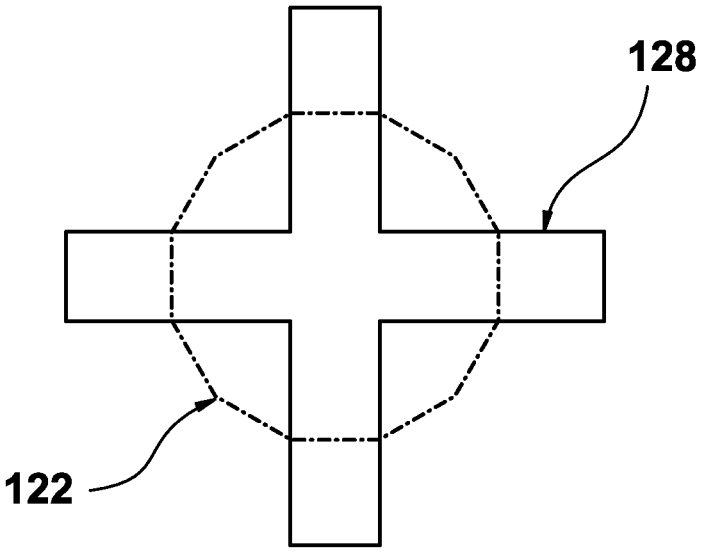
FIG. 3B is a schematic depiction of the cross-sectional shapes of the first cross section and the second cross-section of the shape-shifting tuft shown in FIG. 3A.

Shape-shifting tuft 100 has a mounting end 101 and a free end 109, shape shifting tuft 110 has a mounting end 111 and a free end 119 and shape-shifting tuft 120 has a mounting end 121 and a free end 129. It is understood that the mounting ends 101, 111 and 121 rise from a carrier element that here is assumed to have a flat mounting surface as already mentioned. Any portion of the shape-shifting tufts 100, 110 and 120 that may be disposed in or below the carrier element is not shown (the carrier element is obviously also not shown). FIGS. 1B, 2B and 3B show the outlines of a first cross-section 102, 112 and 122, respectively, taken in a first plane coinciding with the level of the mounting surface and of a second cross-section 108, 118 and 128, respectively, taken in a second plane parallel to the first plane and coinciding with the level of the free ends 109, 119 and 129, respectively, of the shape shifting tufts 100, 110 and 120, respectively. In accordance with the present disclosure, the cross-sectional area of the first cross-section in each example is essentially identical with the cross-sectional area of the second cross section of the same example, while the cross-sectional shape of the first cross section of each example is different to the cross-sectional shape of the second cross-section of the same example.

In all three examples, the first cross-section is circular or circular-like (e.g. dodecagon-like as in FIG. 3A, 3B), but this shall not be understood as limiting as the first cross-sectional shape may take any sensible shape. It may preferably take a shape that provides, e.g., a bending stiffness that is higher or lower than the bending stiffness that the shape-shifting tuft has at its free end. For example, an elongated or V-shaped or +-shaped free end has an overall rather low bending stiffness while it provides certain cleaning properties like a debris-collecting concavity or a broad cleaning edge that may provide beneficial cleaning effects. This low bending stiffness can be counterbalanced by the cross-sectional shape of the shape-shifting tuft closer to its mounting base, which cross-sectional shape may be circular or circular-like. But a skilled person may also see benefits in a low bending stiffness at the base and a compressed fiber arrangement at the free end or in an elongated cross-sectional shape at the base and a V-shape at the free end etc.

For the shape-shifting tuft 100 shown in FIGS. 1A and 1B the cross-sectional shape of the second cross-section 108 is essentially V-shaped, for the shape-shifting tuft 110 shown in FIGS. 2A and 2B the cross-sectional shape of the second cross-section 118 is shaped like an elongated wedge profile with rounded edges, and for the shape-shifting tuft 120 shown in FIGS. 3A and 3B the cross-sectional shape of the second cross-section 128 is +-shaped (i.e. shaped like the mathematical symbol "plus"). It is understood that these cross-sectional shapes as shown can only approximately be realized with a limited number of fibers per tuft (e.g. below about 500 fibers or below about 350 fibers or below about 200 fibers or below about 150 fibers or below about 100 fibers, preferably between 20 and 500 fibers). It shall also be understood that the fibers of a tuft have a tendency to slightly diverge from each other from the mounting base to the free end (so-called "flowering" of the tuft) so that the cross-sectional area of the second cross-section may in practice be slightly larger than the first cross-sectional area of the first cross section even though this is not intended.

In examples not shown in FIGS. 1A, 1B, 2A, 2B, 3A and 3B, the free end of a shape-shifting tuft may have a three-dimensional topology, i.e. the free ends of the individual fibers then do not end in essentially one plane (whether inclined or not with respect to the mounting surface), but the free ends of the fibers may end on a three-dimensional surface or may end irregularly. That means that the individual fibers of a tuft end at different lengths. By way of example, it is referred to FIG. 4A, where a center tuft has a convex free end. In such a case, the second cross-section will be taken in a second plane that crosses all the fibers that cross also through the first plane, i.e. the second plane will be located just below the convex free end.

For sake of completeness it is stated that all cross sections taken in an intermediate plane parallel to the first plane but closer to the first plane than the second plane will of course also cross through all fibers that cross through the first plane and the cross-sectional area of this respective intermediate cross-section will essentially be the same as the cross-sectional area of the first cross section or the second cross-section. It is then the case that the cross-sectional shapes of intermediate cross-sections taken at planes having increasing distances to the first plane will smoothly morph from the first cross-sectional shape into the second cross-sectional shape.

Figure 4A:
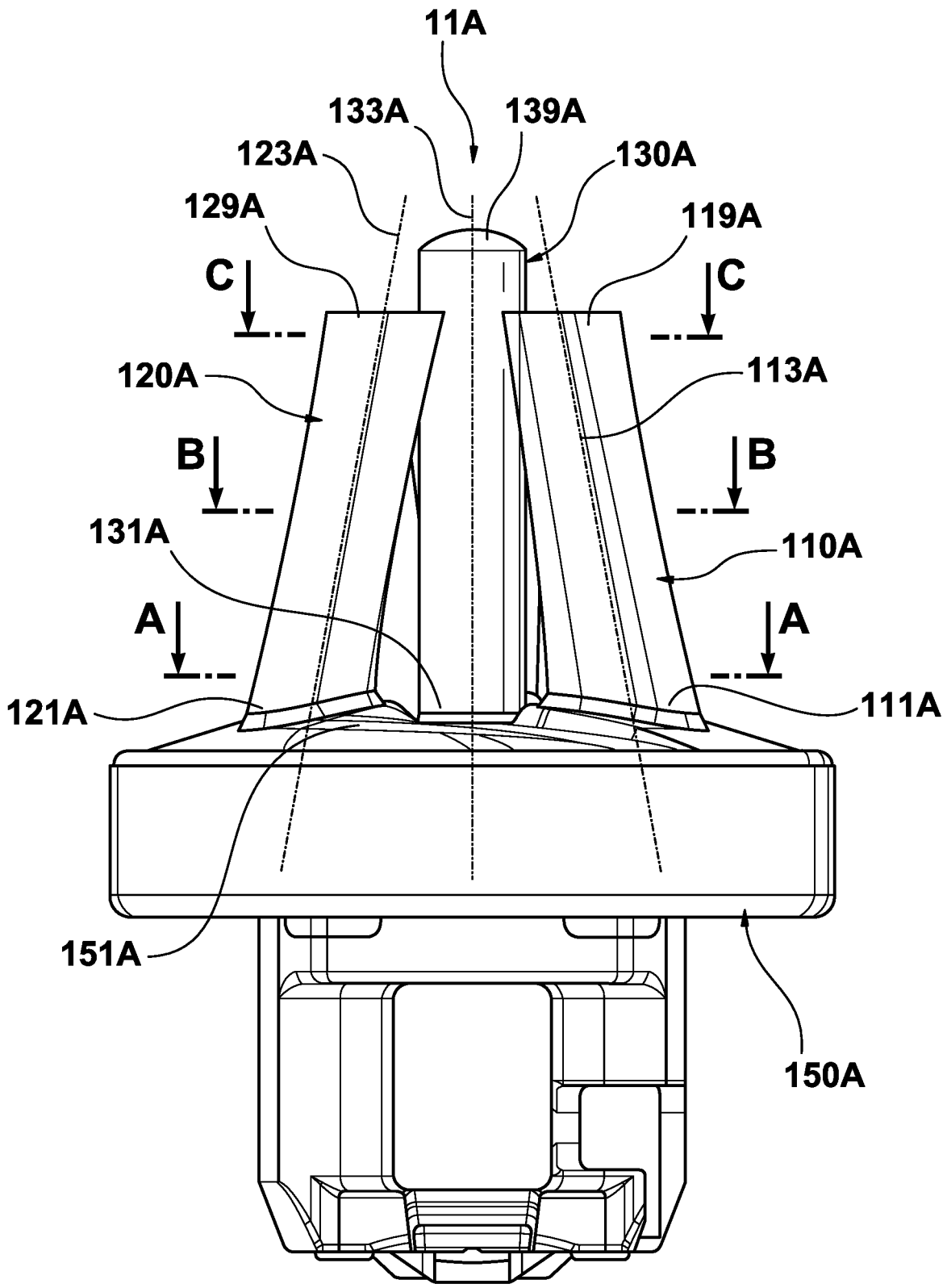
FIG. 4A is a side view onto an example brush carrier for a brush head in accordance with the present disclosure, where three shape-shifting tufts are mounted on a carrier element.

While the example embodiments shown in FIGS. 1A, 2A and 3A assume a planar mounting surface, it shall be understood that the mounting surface may be non-planar (as is indicated in FIG. 4A), e.g. the mounting surface may be curved or may comprise steps. To the extent the present disclosure mentions a normal to the mounting surface, it is understood that this means a normal on a smoothly interpolated mounting surface at the center of area of the base of the shape-shifting tuft. The extension direction of a tuft may be inclined against such a mounting surface normal. A tuft may be circumferentially inclined, e.g. in clockwise or anti-clockwise direction with respect to a center point such as the real physical center point of the carrier element, or a tuft may be inclined in a radially inwards or outwards oriented manner A tuft may of course be arbitrarily inclined to serve any need. Inclination angles shall not be understood as being limited but often are in a range of between and including 0 to 20 degrees such as 5 degrees or 7 degrees or 11 degrees or 14 degrees or 15 degrees or 16 degrees or seventeen degrees or eighteen degrees or any other value. In case of a curved mounting surface, tufts may be differently inclined against a mounting surface normal while the extension directions of the tufts may still be all parallel to each other.

Example Toothbrush Head comprising Shape-Shifting Tufts

Figure 5:
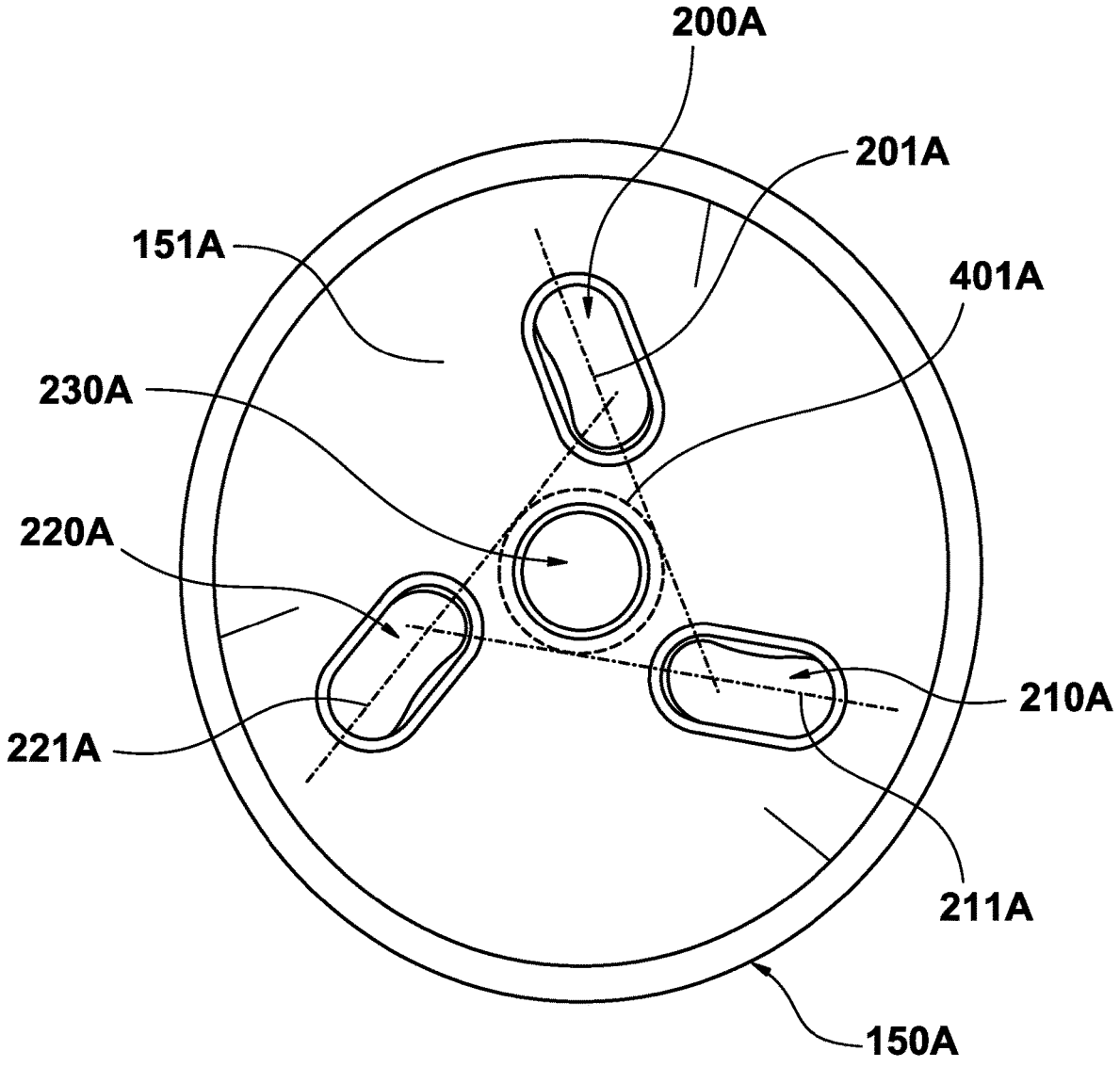
FIG. 5 is a top view onto the carrier element where the shape-shifting tufts are removed.
Figure 6A:
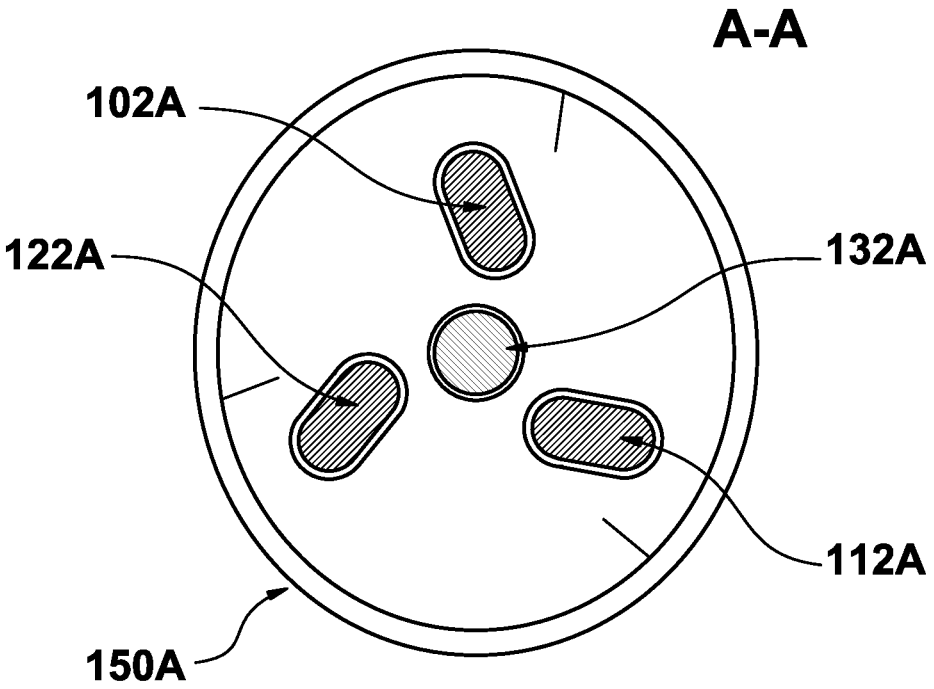
FIG. 6A is a top view onto a cross-sectional through the brush carrier shown in FIG. 4A taken at plane A-A as indicated in FIG. 4A.
Figure 6B:
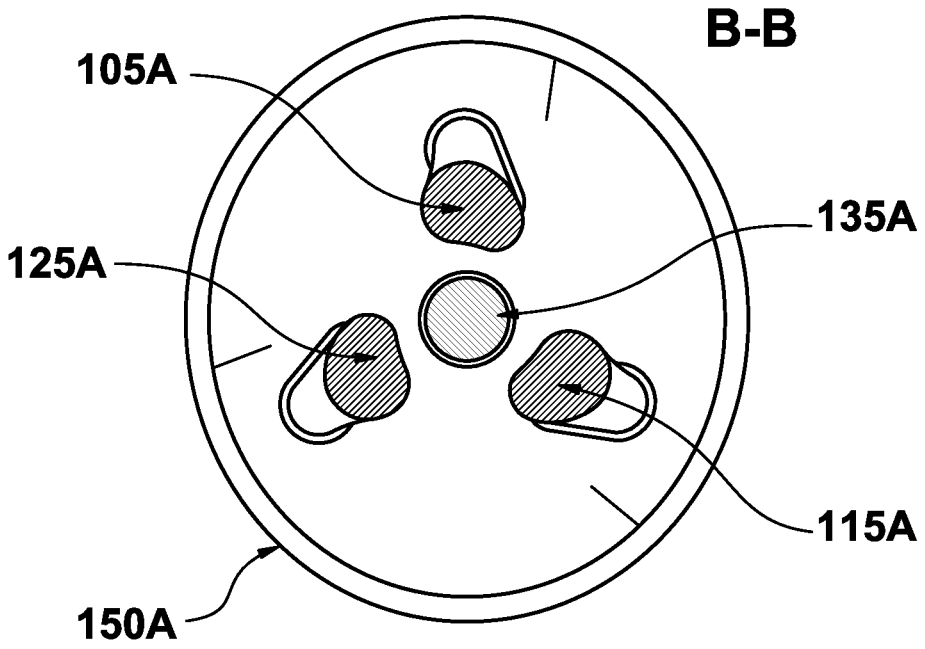
FIG. 6B is a top view onto a cross-sectional through the brush carrier shown in FIG. 4A taken at plane B-B as indicated in FIG. 4A.
Figure 6C:
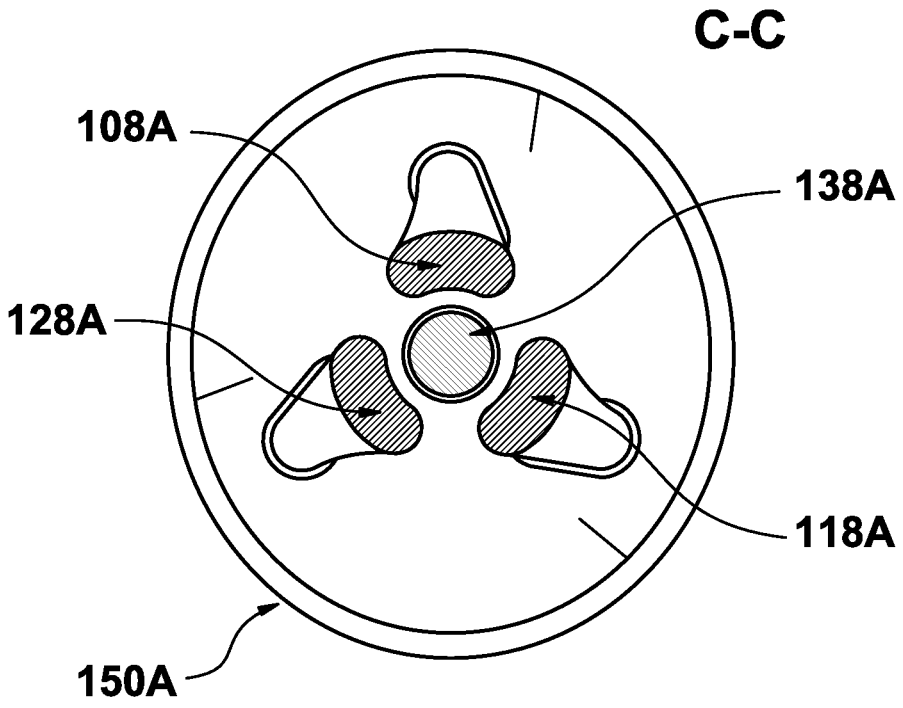
FIG. 6C is a top view onto a cross-sectional through the brush carrier shown in FIG. 4A taken at plane C-C as indicated in FIG. 4A.
Figure 7:
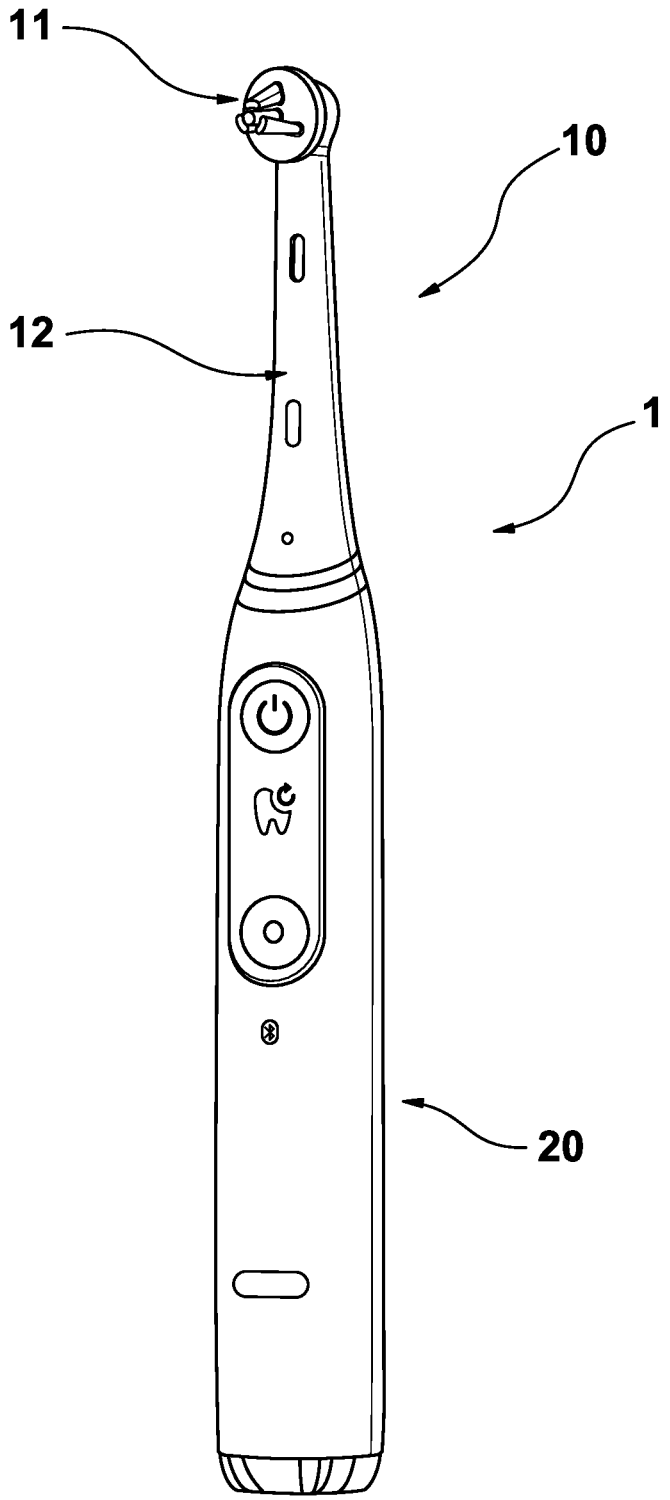
FIG. 7 is a depiction of a toothbrush comprising a toothbrush head in accordance with the present disclosure.

FIGS. 4A, 4B, 5, 6A, 6B, 6C relate all to one example brush carrier 11A comprising three shape-shifting tufts 100A, 110A, 120A and a further tuft 130A all mounted on a carrier element 150A comprising a mounting surface 151A. While here only the brush carrier 11A comprising the tufts 100A, 110A, 120A, 130A and the carrier element 150A is shown, it shall be understood that this brush carrier 11A may be mounted at a brush housing to form a toothbrush head; toothbrush head 10 as shown in FIG. 7 is referred to as an example, but it shall be clear that a toothbrush head may be also a non-detachable portion of a toothbrush, e.g. the toothbrush head of a manual toothbrush is typically not detachable, while the toothbrush head of an electric toothbrush typically is replaceable.

Figure 4B:
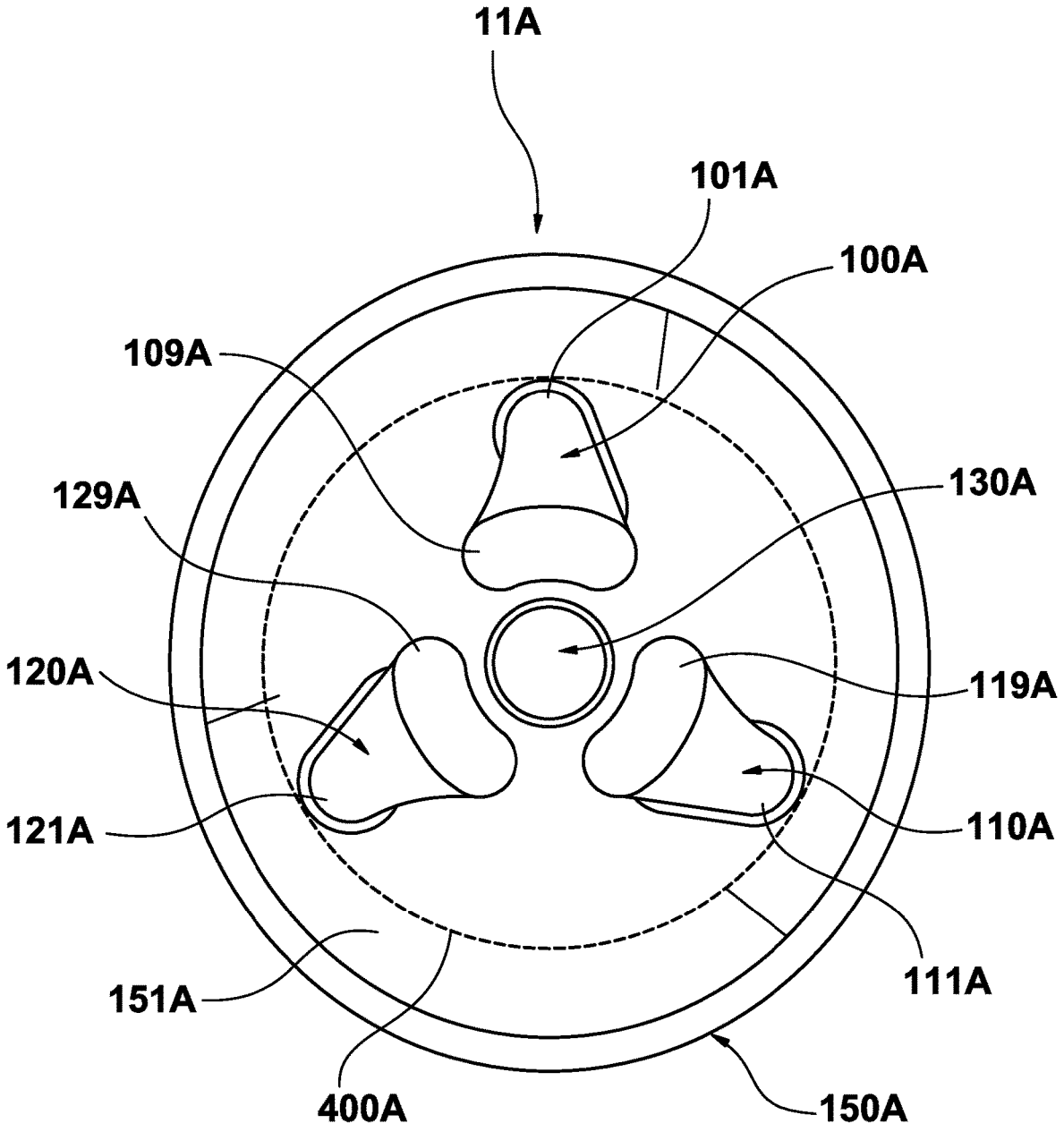
FIG. 4B is a top view onto the brush carrier shown in FIG. 4A.

FIGS. 4A and 4B show a side view and a top view of the example brush carrier 11A. The three shape-shifting tufts 100A, 110A and 120A are approximately arranged on a circle 400A around the further tuft 130A that due its position may also be called a center tuft 130A. The tufts 100A, 110A, 120A and 130A are all mounted on the mounting surface 151A of the carrier element 150A. The three shape-shifting tufts 100A, 110A and 120A are arranged along the circle 400A with a 120-degree equiangular distance between each neighboring tuft. The center tuft 130A is mounted in the center of the circle 400A that is also the center of the carrier element 150A. The center tuft 130A is here shown as a straight circular tuft, but the center tuft may also have many other cross-sectional shapes, e.g. a triangular shape. The shape-shifting tufts 100A, 110A and 120A are all identically shaped and are all inclined towards the center tuft 130A. The shape-shifting tuft 100A has a mounting end 101A and a free end 109A, the shape-shifting tuft 110A has a mounting end 111A and a free end 119A, the shape-shifting tuft 120A has a mounting end 121A and a free end 129A and the center tuft 131 has a mounting end 131A and a free end 139A, where the free end 139A of the center tuft 130A has a non-planar free-end topography that is spherically shaped, i.e. the ends of the fibers of the center tuft 130A end on a segment of a sphere. But this is just one example and shall not be understood as limiting. The shape-shifting tuft 110A generally extends along extension direction 113A, the shape-shifting tuft 120A generally extends along extension direction 123A and the center tuft 130A generally extends along extension direction 133A. FIG. 4A indicates three parallel planes A-A, B-B and C-C through which cross-sectional cuts are taken that are shown in FIGS. 6A, 6B and 6C. Plane A-A is here shown at a first length along the extension direction, which first length is close to the mounting surface 151A and thus close to the mounting ends 101A, 111A and 121A and plane C-C is shown at a second length along the extension direction, which second length is close to the free ends 109A, 119A and 129A of the shape-shifting tufts 100A, 110A and 120A.

FIG. 5 is a top view onto the carrier element 150A where the tufts are removed. Tuft holes 200A, 210A and 220A are shown that all have an elongated lozenge-like shape in the mounting surface 151A. Likewise, a circular tuft hole 230A for the center tuft is visible. The long axes 201A, 211A and 221A of the lozenge-shaped tuft holes are indicated by a dashed line, which long axes, when extended beyond the respective tuft hole, are tangential at a circle 401A around the center of the carrier element 150A. In comparison with FIG. 4B it is clear that this circle 401A defines a relatively small center area in the center of the carrier element 150A. In other examples, a long axis of a tuft hole of a shape-shifting tuft may point towards the center or another extended center area.

FIGS. 6A, 6B and 6C show cross-sectional cuts through the brush carrier 11A taken along parallel planes A-A, B-B and C-C, respectively, as indicated in FIG. 4A. FIG. 6A shows the cross-sectional cut taken in plane A-A with view direction onto the carrier element 150A. The first cross-sections 102A, 112A and 122A of the three shape-shifting tufts can be seen, which first cross-sections 102A, 112A and 122A all have an elongated, generally lozenge-like cross-sectional shape. The center tuft has a first cross-section 132A that has a circular shape. FIG. 6C shows the cross-sectional cut taken in plane C-C with view direction onto the carrier element 150A. The second cross-sections 108A, 118A and 128A of the three shape-shifting tufts can be seen, which second cross-sections 108A, 118A and 128A all have a curved bean-like cross-sectional shape, where a concavity of the bean-like cross-sectional shapes partially envelopes the central tuft, which of course has a circular cross-sectional shape 138A. These specific second cross-sectional shapes of the shape-shifting tufts enables a high fiber density in the central free end area of the brush carrier 11A so that specifically interdental areas of the dentition can be cleaned with a high number of fibers arranged in a rather small area. FIG. 6B shows the cross-sectional cut taken in plane B-B with view direction onto the carrier element 150A. Intermediate cross-sections 105A, 115A and 125A of the three shape-shifting tufts can be seen, which intermediate cross-sections 105A, 115A and 125A provide an impression on how the lozenge-shaped elongated first cross-sectional shape morphs into the bean-like second cross-sectional shape. The cross-sectional shape 135A of the center tuft is of course not changed.

Example Toothbrush

FIG. 7 is a depiction of an example toothbrush 1 comprising a handle part 20 and a toothbrush head 10 in accordance with the present disclosure that is here detachably attached to the handle part 20. The toothbrush head 10 comprises a brush carrier 11 that is mounted for driven motion with respect to a toothbrush head housing 12.

Method of Manufacturing a Shape-Shifting Tuft

Figure 8:
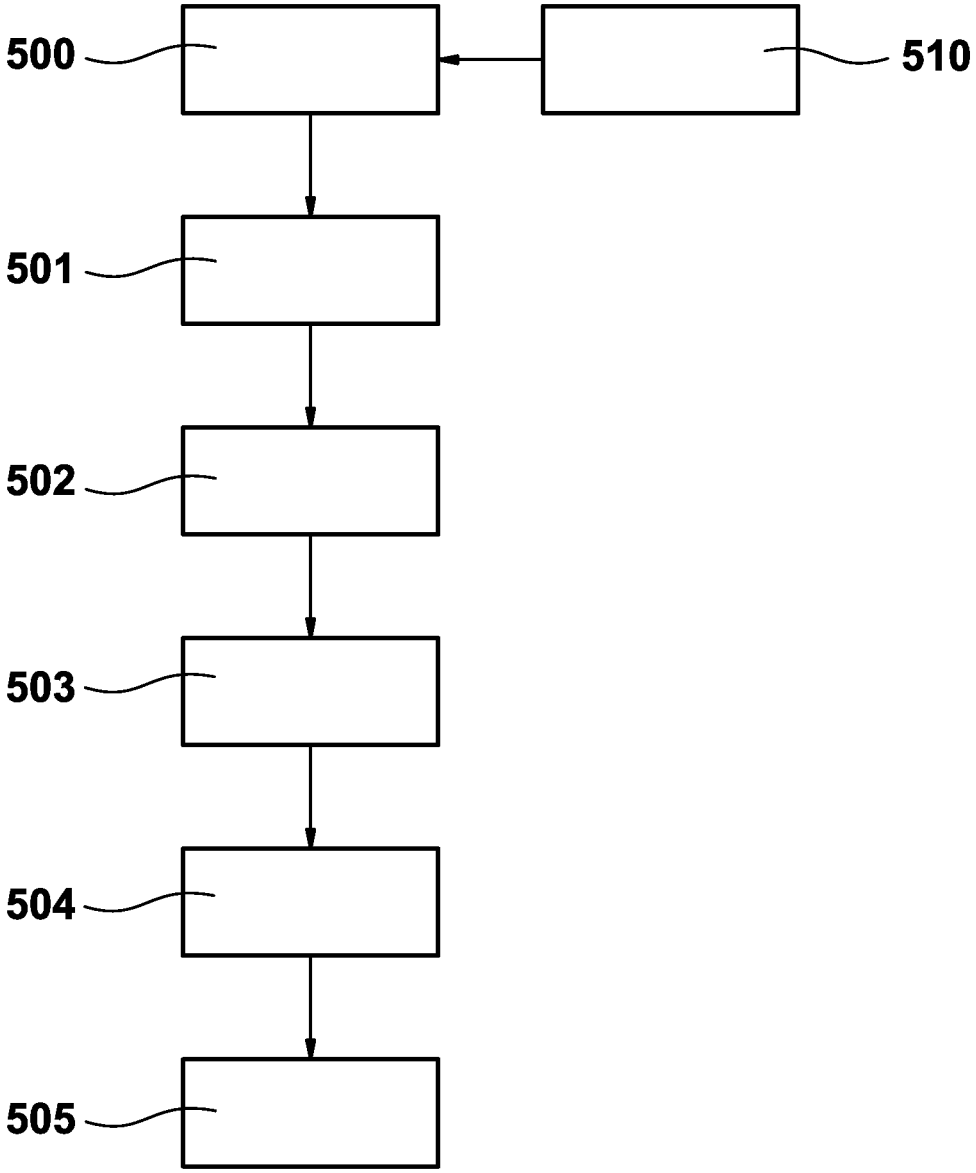
FIG. 8 is a flow diagram of a manufacturing process for making a toothbrush head or brush carrier in accordance with the present disclosure.

FIG. 8 depicts processing steps of a method to manufacture a brush carrier or toothbrush head comprising at least one shape-shifting tuft.

At step 500, a mold-insert having at least one cavity for defining a shape-shifting tuft is provided. The cavity has a length and extends from a first side of the mold insert to a second side of the mold insert opposite to the first side along an extension direction. Further, the cavity has a first cross section at a first length having a first cross-sectional shape and area and a second cross-section at a second length having a second cross-sectional shape and area, where the planes in which the cross-sections are taken are parallel to each other, preferably where the plane at the first length coincides with the first side or is at least as close to the first side as possible without the first cross-section crossing through the first side and further preferably where the plane at the second length coincides with the second side or is at least as close to the second side as possible, and the first cross-sectional area and the second cross-sectional area are substantially identical and the first cross-sectional shape and the second cross-sectional shape are different so that the first cross-sectional shape does not match the second cross-sectional shape independent from an angle by which the first cross-sectional shape is rotated and independent from a displacement of the first cross-sectional shape. The mold insert may have a plurality of cavities that either define further shape-shifting tufts or non-shape-shifting tufts, e.g. circular tufts or other constant or twisting cross-section tufts.

At step 501, which is an optional step, either the cavity is closed at the second side by a closing element that may define a planar or non-planar fiber abutting surface or a closing element is positioned in close proximity to the second side, e.g. at a distance in the range of 0.01 mm to 10 mm, so that the free ends of fibers that may be introduced into the cavity from the first side abut at a fiber abutting surface of the closing element that defines a planar or non-planar free end of the tuft that is defined by the cavity.

At step 502, fibers are introduced into the cavity from the first side, where each fiber has a first end (that will become the free end) and a second end, and the second ends of the fibers remain outside of the mold insert on the first side. When the fibers are introduced into the cavity, they will orient themselves in a manner to accommodate the shape-shifting tuft cavity. Some shaking or a vibration of the mold insert may be used to support the arrangement of the fibers and to avoid that individual fibers become arranged with a pre-stress. Due to the shape-shifting form of the cavity and potentially due to the topology of the free end of the tuft defined by the closing element, the fibers will have a different length in the cavity and they thus may extend on the first side with different heights. A cutting step may be applied to cut the fibers to a common length. In the filling step, a high degree of filling of the tuft cavity may be applied, e.g. the cavity filling may be above 50%, above 60%, above 65%, above 70% or above 75%.

At step 503, at least one of melting the second ends of the fibers together so that a joint end of the plurality of fibers is formed or connecting the second ends of the fibers by applying a connecting material such as an adhesive so that a joint end of the plurality of fibers is formed is done. In each case the plurality of fibers and the joint end form a shape-shifting tuft. The step of melting the second ends together or the step of connecting the second ends by means of a connecting material does ideally not introduce any new pre-stress but rather relieves any pre-stress still present.

At step 504, the joint end of the shape-shifting tuft is connected with a carrier element, preferably by injection molding of the carrier element around the joint end. The mold insert may then form a first mold half or may be a component of a first mold half so that the mold insert and a further mold half define a mold cavity for the carrier element. Generally, a mold insert may comprise a plurality of groups of tuft cavities, where each group relates to one carrier element.

At step 505, the plurality of fibers, i.e. the at least one shape-shifting tuft, is removed from the tuft defining cavity together with the carrier element that is demolded from the molding cavity. While the fibers are temporarily bent in the removal process, they will spring back into the orientation that was given to the plurality of fibers by the cavity after removal due to the fact that their orientation is essentially fixed by the joint end. As the fiber introduction and the connection of the second ends has avoided introducing any pre-stress, the shape of the removed shape-shifting tuft will essentially follow the shape as it was defined by the cavity. As was mentioned before, some unavoidable flowering may occur so that the cross-sectional area may slightly increase towards the free end of the shape-shifting tuft. In case some pre-stress was still present for an individual fiber, the respective fiber may spring into an unstressed position so that the shape of the shape-shifting tuft may be slightly deformed, but it is assumed that the described technology will avoid pre-stress for most embodiments discussed herein.

At step 510, which is an optional step, the cavity is formed by means of wire erosion, where a thin straight wire cuts through the material of the mold insert. The wire may thus be moved along the edges of the cross-sectional shapes on the first side and on the second side and thus the shape of the shape-shifting tuft is defined by straight lines as was explained in a previous paragraph. Other technologies to form the cavity may be employed as well. E.g. the mold insert may be assembled from thin sheets, where the cavity is formed in each sheet by etching or laser cutting or laser ablation or other electrical discharge machining (EDM) in addition to wire erosion. A further technology that may be used is 3D printing, e.g. direct metal laser sintering or selective laser sintering or selective laser melting or electron beam melting. The mold insert may also be made from ceramics or polymeric materials using 3D printing technology.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A toothbrush head or a brush carrier comprising:

at least one carrier element;

at least one shape-shifting tuft mounted on the carrier element such that the shape-shifting tuft raises from a mounting end on a mounting surface of the carrier element generally along an extension direction towards a free end of the shape-shifting tuft;

the shape-shifting tuft having a length from the mounting base to the free end;

the shape-shifting tuft comprising a plurality of fibers;

the shape-shifting tuft having a first cross-section having a first cross sectional area and shape at a first length along the extension direction, and a second cross-section having a second cross-sectional area and shape at a second length along the extension direction;

wherein the planes in which the cross-sections are taken are parallel to each other, wherein the plane at the first length coincides with the mounting surface or is at least as close to the mounting surface as possible without the first cross-section crossing through the mounting surface and wherein the plane at the second length coincides with the free end or is at least as close to the free end as possible such that the second cross-section still crosses through all fibers that also cross through the first cross-section, and the first cross-sectional area and the second cross-sectional area are substantially identical and the first cross-sectional shape and the second cross-sectional shape are different from one another so that the first cross-sectional shape does not match the second cross-sectional shape independent from an angle by which the first cross-sectional shape is rotated and independent from a displacement of the first cross-sectional shape.

2. The toothbrush head or brush carrier of claim 1, wherein the free end of the shape-shifting tuft has a non-planar topology.

3. The toothbrush head or brush carrier of claim 1, wherein the cross-sectional shape of the shape-shifting tuft smoothly transitions from the first length to the second length.

4. The toothbrush head or brush carrier of claim 1, wherein at least the second cross-sectional shape has a concavity.

5. The toothbrush head or brush carrier of claim 1, wherein the extension direction of the shape-shifting tuft is inclined against a normal to the mounting surface at the mounting base.

6. The toothbrush head or brush carrier of claim 1, wherein a center of area point of the second cross-section does not coincide with a center of area point of the first cross section when the center of area point of the second cross section is projected onto the first cross-section along a direction that coincides with the direction determined by a surface normal to the mounting surface at the mounting base of the shape-shifting tuft.

7. The toothbrush head or brush carrier of claim 1, wherein the distance between the first length and the second length is about 50 percent or more of the total free length of the shape-shifting tuft.

8. The toothbrush head or brush carrier of claim 1, wherein each of the fibers have a base on the mounting surface, a free end, a length measured between the base and the free end, and an inclination angle measured against the extension direction, wherein at least the inclination angles of two fibers are different.

9. The toothbrush head or brush carrier of claim 1, wherein each point on the outer edge of the first cross-section can be connected with one point on the outer edge of the second cross-section by a straight line defining the outer lateral shape of the shape-shifting tuft in between the first length and the second length.

10. The toothbrush head or brush carrier of claim 1, comprising at least three shape-shifting tufts that are inclined so that their free ends are closer to each other than their mounting bases, wherein the shape-shifting tufts are arranged on a circle or ellipse or oval, wherein a straight center tuft is mounted in the center of the circle.

11. The toothbrush head or brush carrier of claim 10, wherein the free ends of the shape-shifting tufts encircle the center tuft, and wherein each of the at least three shape-shifting tufts has a first cross-sectional shape that is elongated and oriented such that a long axis of the elongated first cross-sectional shape points towards a center point of the circle, ellipse or oval or is a tangential line of a circular, elliptical or oval center area of the circle, ellipse or oval and each of the at shape shifting tufts have a second cross-sectional shape at their free end that is curved around the center tuft.

12. A toothbrush comprising the toothbrush head or the brush carrier of claim 1.

13. The toothbrush of claim 12, wherein the toothbrush comprises a repeatedly attachable and detachable brush portion that comprises the toothbrush head or the brush carrier.

* * * * *